US006095686A

United States Patent [19]

Mohrmann

[11] Patent Number: 6,095,686

[45] Date of Patent: Aug. 1, 2000

[54] PACKAGING BAG FOR SANITARY ARTICLES, IN PARTICULAR DIAPERS, WITH A CARRYING HANDLE OF PLASTIC FOIL

[75] Inventor: Rainer Mohrmann, Warburg, Germany

[73] Assignee: Kobusch Folien GmbH, Warburg, Germany

[21] Appl. No.: 08/549,661

[22] Filed: Sep. 12, 1995

[30] Foreign Application Priority Data

Mar. 12, 1993 [DE] Germany ..... 43 07 842

[51] Int. Cl.[7] ..... B65D 33/10

[52] U.S. Cl. ..... 383/8; 383/21; 383/66; 383/207

[58] Field of Search ..... 383/8, 10, 66, 383/207, 209, 21

[56] References Cited

U.S. PATENT DOCUMENTS

| | | | |
|---|---|---|---|
| 4,730,943 | 3/1988 | Johnson | 383/8 |
| 4,874,256 | 10/1989 | Baines . | |
| 4,934,535 | 6/1990 | Muckenfuhs et al. | 383/8 X |
| 5,427,245 | 6/1995 | Roussel | 383/8 X |

FOREIGN PATENT DOCUMENTS

| | | | |
|---|---|---|---|
| 2122070 | 7/1972 | France . | |
| 4000415 | 7/1991 | Germany | 383/21 |
| 4224639 | 1/1994 | Germany | 383/10 |
| WO 91/08962 | 6/1991 | WIPO . | |

*Primary Examiner*—Jes F. Pascua
*Attorney, Agent, or Firm*—Browdy and Neimark

[57] ABSTRACT

The invention concerns a packaging bag (3), made of plastic sheeting and with a carrying handle (1), for personal-hygiene articles, in particular nappies. The one-piece sheet (8) is closed by means of longitudinal and transverse welds (18, 19) to form a bag (3) having a front (15), a back (16), two ends (11), a bottom (14) and a top (5) with an M-shaped top fold. When full, the bag (3) assumes a parallelepipidal shape. The carrying handle (1) is designed as a flat, one-piece, x-shaped strap (2) which is slit at each end over part of its length. The slit ends of the strap (2) are each welded to the inside of the M-shaped top fold where it is drawn in to form a triangle (10) when the bag is full and hence the parallelepipidal in shape.

15 Claims, 4 Drawing Sheets

PACKAGING BAG FOR SANITARY ARTICLES, IN PARTICULAR DIAPERS, WITH A CARRYING HANDLE OF PLASTIC FOIL

BACKGROUND OF THE INVENTION

1. Technical Field of the Invention

The invention relates to a packaging bag for sanitary articles, in particular diapers which, when filled, has a cuboid shape and consists of a plastic bag foil with a face wall, a rear wall, two front walls closed by weld seams, a bottom, closed by a weld seam after filling, and a cover wall which, during filling, is formed from a folded-open M-shaped head fold, whose two end areas, each pulled into a triangle, are located folded up on the inside of the adjoining front wall. The bag also has a carrying handle made from plastic foil in the shape of a cross tape, which is welded by its cross tape strips at the ends and extends over the entire cover wall between the front walls.

2. Prior Art

Such a packaging bag is generically known from U.S. Pat. No. 4,874,256. However, the ends of the foil handle which have been separated by means of an elaborate stamping process are welded at the front outside to the front walls there. Further, the length of the foil handle corresponds only to the length of the M-shaped head fold, so that in the filled state of the packaging bag it rests tightly pulled on the top of the packaging bag. Because of this, gripping it from below by hand is made considerably more difficult; furthermore, carrying the packaging bag is unpleasant, since the fingers do not have a clear space and are always somewhat pinched. The foil ends welded to the outside of the bag wall are unprotected there, so that there is the danger that the ends of the foil grip come partially or completely loose from the packaging bag because of frictional contact, for example when pulling a packaging bag out of a stack. Furthermore, the ends of the carrying handle fixedly placed on the exterior obstruct the space for placing the perforation for a tear strip to be torn from the top.

Furthermore, a packaging bag known from WO 91/08962 has a carrying strip of a closed tape, which is inserted without anadditional length into the M-shaped head fold and is directly welded into the weld seam of the front walls, for which reason the tear perforation is arranged respectively laterally thereof and can only be torn open from below. This is made difficult by the great lateral fill pressure of the package and because of which the carrying strip loses its support after tearing.

OBJECT AND SUMMARY OF THE INVENTION

Based on the above defined prior art, it is the object of the invention to equip a packaging bag with a carrying handle which makes easy gripping possible and has a proper distance in height from the cover wall of the packaging bag for comfortable carrying of the packaging bag and in the process is integrated in a simple, secure and esthetically pleasing manner with the packaging bag and welded thereon, and to make simple opening and tearing open possible while the handle can be still used.

The object is attained in that the cross tape strips formed by slits are respectively welded to the triangles formed by the head fold and that a perforation line for a tear strip is placed in the bag between the cross tape strips.

The packaging bag for sanitary items in accordance with the invention with a carrying handle of plastic foil, whose one-piece bag foil is closed by weld seams to form a bag comprising a face wall, a rear wall, two front walls, a bottom and a cover wall with an M-shaped head fold, takes on the shape of a rectangular block when filled with packages.

The M-shaped head fold is folded open to form the cover wall in the filled state forming the rectangular block shape. Due to the fact that the four foil layers of the M-shaped head fold are welded to each other on the front along a quadruple weld, the cover wall is pulled in in a triangular shape when filled with packages. The carrying handle is embodied as a one-piece, flat cross tape, slit at both ends over a portion of the carrying length. The slit, long ends of the cross tape are respectively welded on the inside of the head fold which is pulled in at the front in a triangular shape in the respective state when filled with packages.

The cross tape ends therefore disappear in the head fold which is pulled in at the front in a triangular shape and their welded connection is disposed there and protected against the outside. Furthermore, the cross tape which otherwise rests loosely wound on the packaging bag, can be cleverly and esthetically stowed in the space (gap) of the respectively triangularly pulled-in head fold. The part which is stowed in this way can be pulled out when the cross tape is grasped for carrying the packaging bag.

The spread cross tape end lying on the inside leaves a space for a perforation of a tear strip. It can be easily grasped at the upper freely extending end of the front wall or on the cover wall, which is exposed to little pressure, and can be torn open downwardly. The handle is not affected by this.

To produce this carrying handle, a flat plastic tape being rolled of an endless roll is longitudinally slit in a clocked manner and is cut transversely to the linear direction to form the individual slit cross tapes, wherein no waste occurs.

BRIEF DESCRIPTION OF THE DRAWINGS

Exemplary embodiments are represented in the drawings and will be explained in detail below. Shown are in.

DETAILED DESCRIPTION OF THE PREFERRED EMBODIMENT(S) OF THE INVENTION

Figure 1:
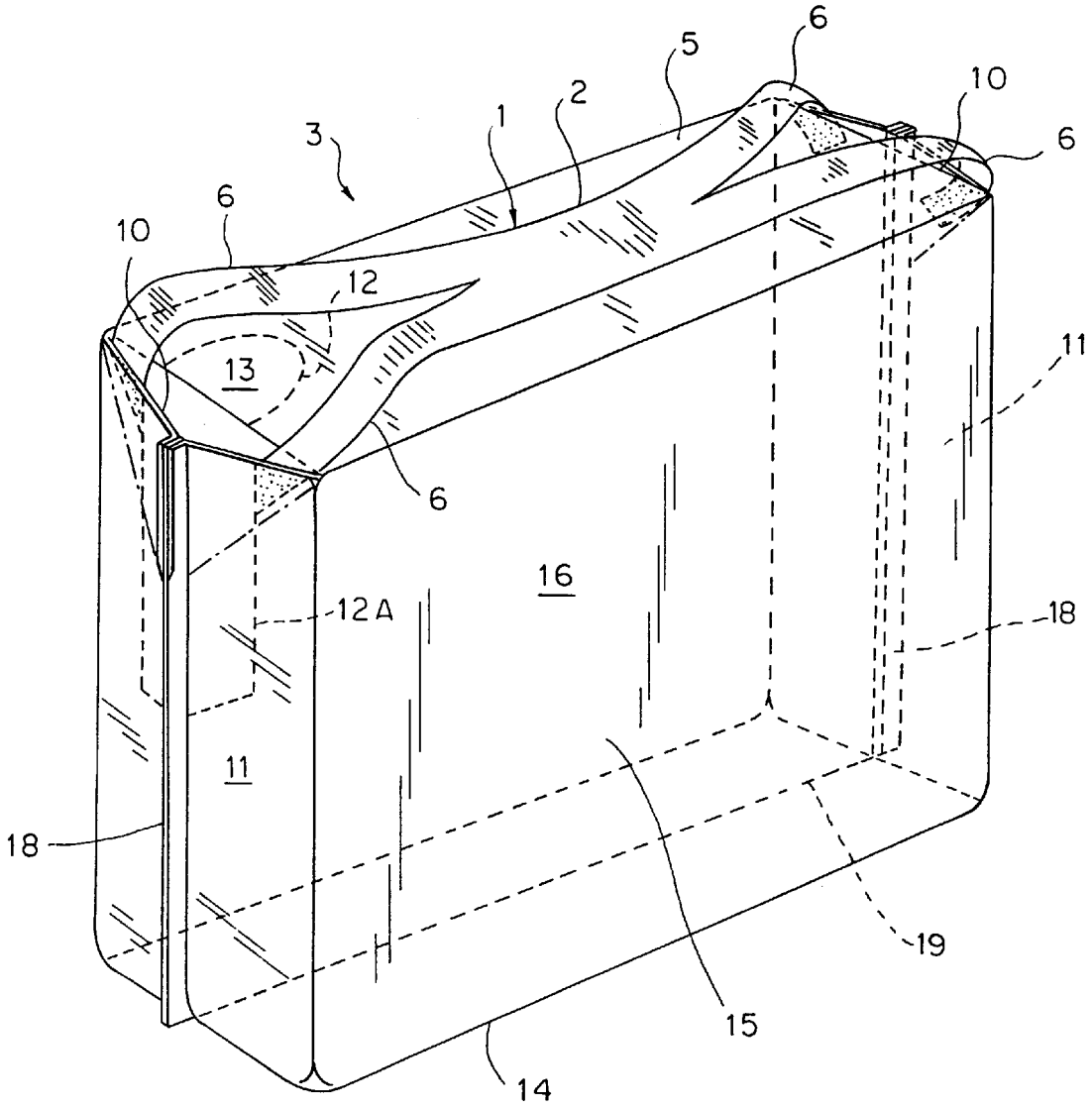
FIG. 1, a perspective view of a packaging bag with a carrying handle.

The packaging bag (3) for sanitary items, in particular diapers, with a carrying handle of plastic foil, whose one-piece bag foil (8) is closed by a longitudinal weld (18) and transverse weld seams (19) to form a bag comprising a face wall (15), a rear wall (16), two front walls (11), a bottom (14) and a cover wall (5) with an M-shaped head fold (4), takes on the shape of a rectangular block when filled with packages, wherein the carrying handle (1) is embodied as a one-piece, flat cross tape (2), slit at both ends over a portion of the carrying length.

The bag foil (8) is welded together at the front by means of longitudinal weld seams (18).

The four ends of the foil layers of the M-shaped inserted head fold (4) of the packaging bag (3) are welded together at the front wall (11) along a four fold weld seam on folded edges 10*a*.

In the filled state which forms the rectangular block shape, the M-shaped head fold (4) is folded open for forming the cover wall (5). Due to the respective four-fold foil weld on folded edge 10*a* at the front, the cover wall (5) is pulled in at the front in a triangular shape in the state where it is filled with packages.

The slit cross tape ends are respectively welded on the inside of front wall (11) in front of the head fold (4) which is pulled in from the front wall in the shape of a triangle (10) in the filled state forming the rectangular block shape. The welded connection of the cross tape ends (6) is disposed between front wall (11) and triangle 10 in a protected manner. Furthermore, the cross tape (2) which otherwise rests loosely wound on the packaging bag (3), can be cleverly and esthetically stowed in the space (gap) between the front wall (11) and the respective triangularly pulled-in head fold (4). When grasping the cross tape (2) for carrying the packaging bag (3), the part of the cross tape (2) which is stowed in this way can be pulled out.

The triangle (10), respectively formed in the filled state which forms the rectangular shape because of the M-shaped head fold (4) being pulled in from the front wall (11), has a folded edge (10A) extending from the lower end of the four-fold weld seam to respectively the upper corner of the packaging bag (2).

Figure 4:
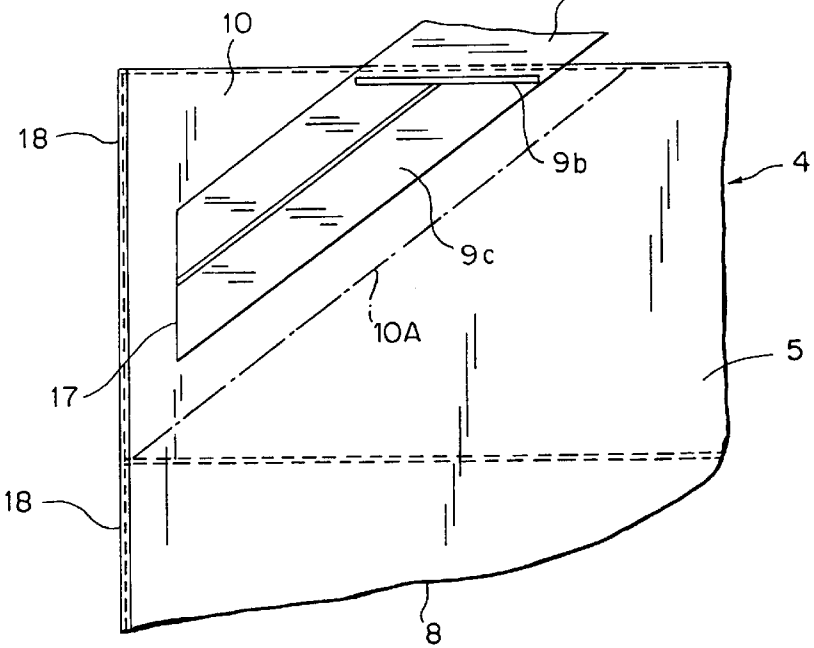
Figure 3:
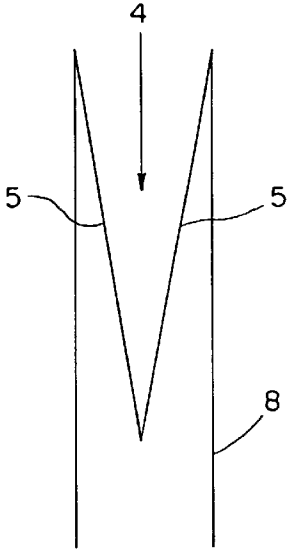
FIG. 3, a vertical section through the partially folded open packaging bag with the M-shaped head fold, FIGS. 4 to 6, top views of respectively different cross tape strips welded to the triangularly pulled-in head fold, FIG. 7, a lateral view of a cross tape strip, folded over at the end and welded to the triangularly pulled-in head fold.
Figure 5:
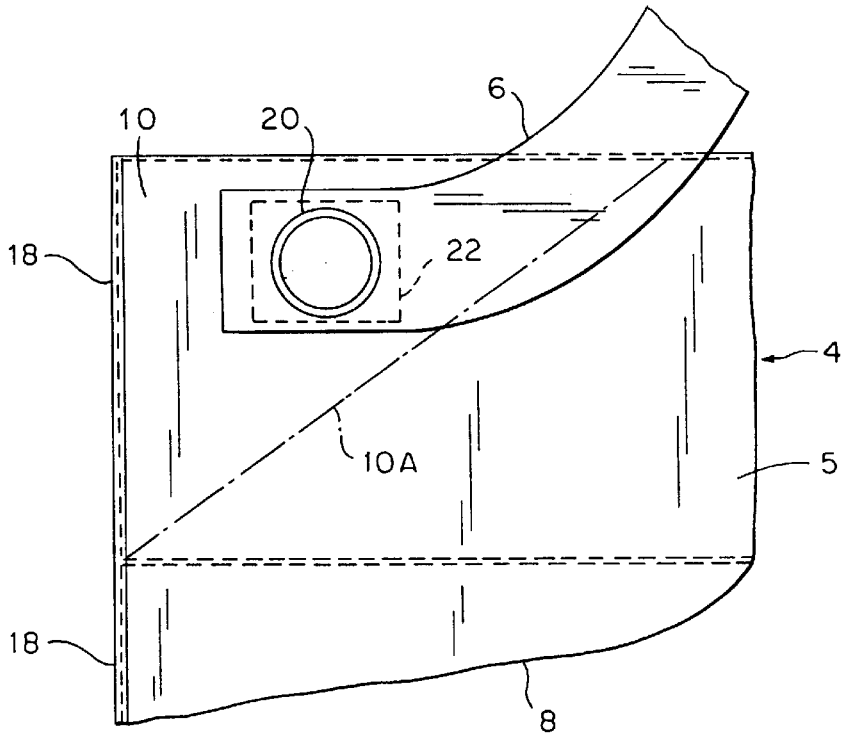
Figure 6:
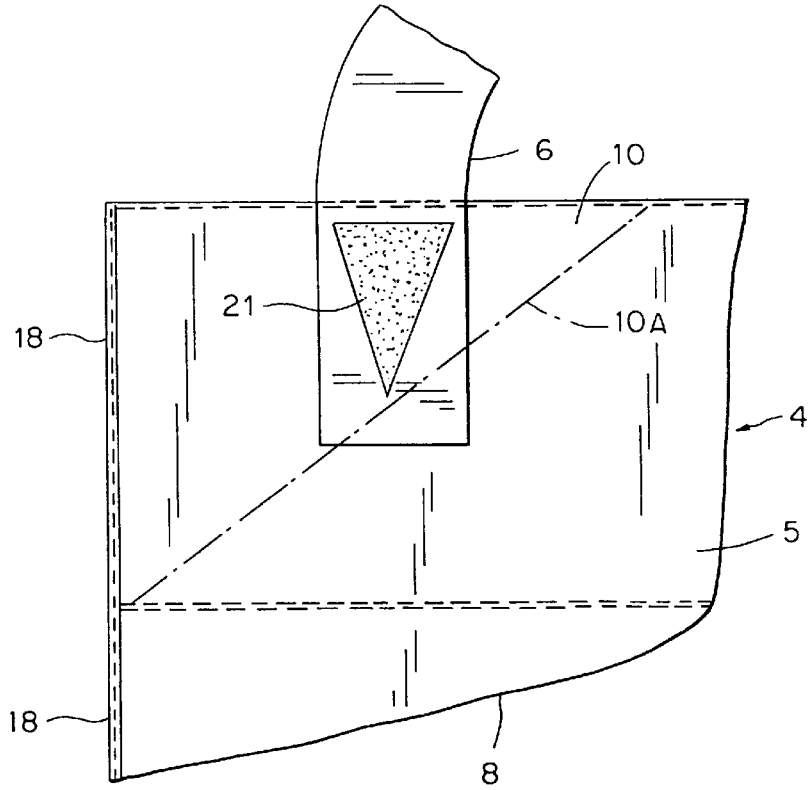

The cross tape (2) has respectively two cross tape strips (6) at both ends, extending symmetrically to the linear direction and formed by separating slits over approximately ⅓ of the entire cross tape length, wherein the section in the center between the cross tape strips (6), which is not slit, constitutes the carrying element (7). The slit cross tape strips (6) can each have an end edge (17) at the end extending transversely from the inside to the outside, or an end edge extending transversely in respect to the longitudinal direction of the cross tape strips (6). The slit cross tape strips (6) are fixed in place on the inside of front wall (11) of the bag foil (8) and doubled there, at the end of the M-shaped head fold (4), which is pulled in from the front wall (11), by means of welded connections in a horizontal, vertical or diagonal position located therebetween (see FIGS. 4 to 6). In this case the cross tape strips (6) can be respectively welded with the doubled bag foil (8) by means of two weld seams (9*a*, 9*b*), wherein the one weld seam (9*a*) extends in the longitudinal direction of the cross tape strip (6), and the other weld seam (9*b*) slightly below the cover wall (5) and parallel with it (see FIG. 4). Alternatively to this, the cross tape strips (6) can respectively be welded to the front wall (11) of the doubled bag foil (8) by means of a circular weld seam (20) or by means of triangularly or rectangularly disposed weld seams (21) (22). It is furthermore also possible that the cross tape strips (6) are respectively welded to the doubled bag foil (8) by means of a weld surface (21) in the shape of a circle (20), a triangle (21) or a rectangle (22). The cross tape can be folded to lie on top of itself on the carrying element (7).

Figure 7:
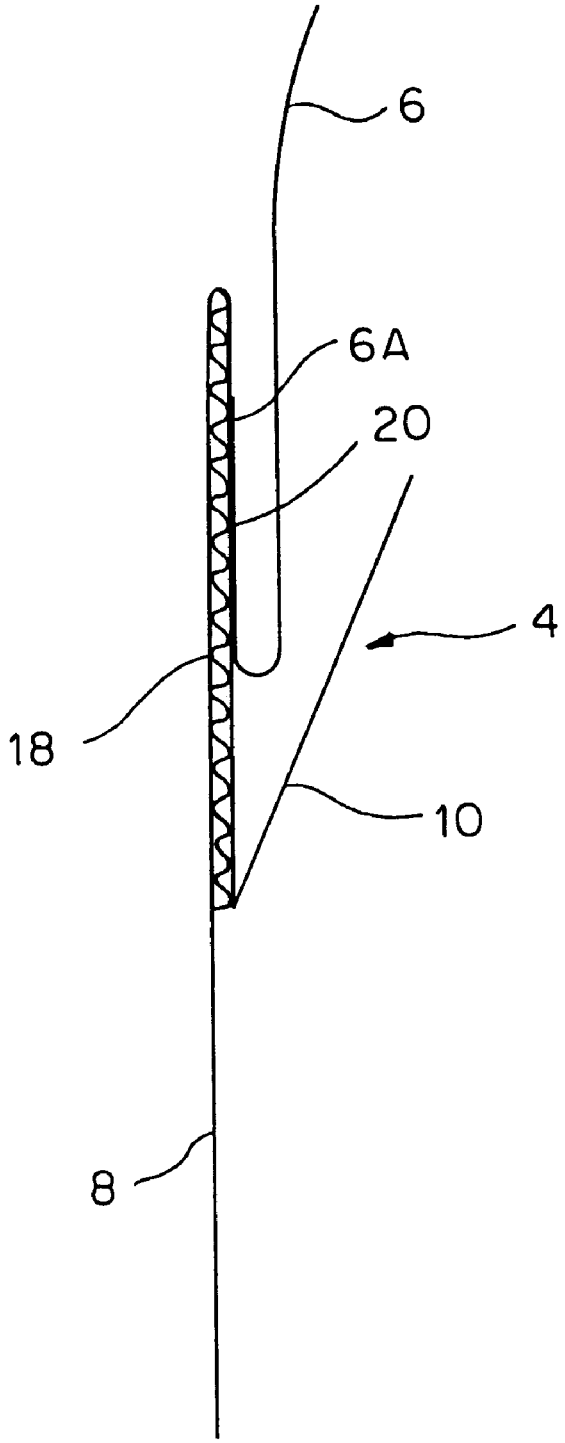

A further embodiment of the fastening of the cross tape strips (6) is represented in FIG. 7 and is applicable in combination with all the preceding embodiments. The cross tape strip (6) is folded over toward the top at the end and is inserted vertically from above in the head fold (4), which is pulled in at the front in a triangular shape, and tape strip (6) is welded at the folded-over end (6*a*) in the manner shown in any of the other embodiments to the bag foil (8) doubled there. The cross tape strips (6) are placed doubled up in the gap of the head fold (4) pulled in from front wall (11).

Excess cross tape (2) can be stowed in a particularly advantageous manner in the gap of the head fold (4) pulled in at the front by means of this type of fastening.

This fastening was shown to be particularly stable and tear-resistant in tests and test measurements.

Perforation lines (12A) extending from top to bottom are cut into the front wall (11) and triangle 10 and, if desired, a perforation line (12) is also continued in the cover wall (5) and forms a tear strip (13). The above described cross tape (2) and its fastening permit unhampered access to this tear strip (13) in an advantageous manner.

In the filled state forming the rectangular block shape, the weld strips (9, 20, 21, 22) of the cross tape strips (6) lie against the insides of the front walls (11) of the packaging bag (3).

Figure 2:
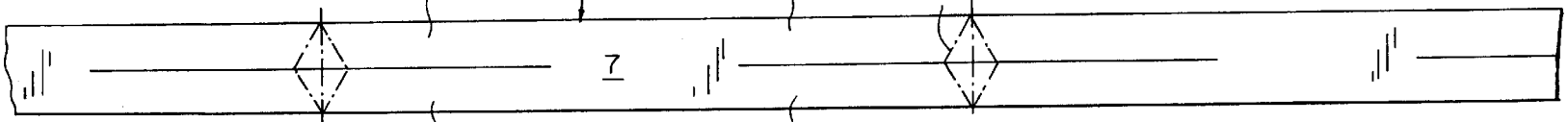
FIG. 2, a top view of the rolled out, partially slit plastic tape.

To produce the carrying handle 1, a flat plastic tape being rolled off an endless roll is longitudinally slit in a clocked manner to form the cross tape strips (6) and is cut transversely to the linear direction to form individual slit cross tapes (2) with an unslit center carrying element (7) and cross tape strips (6) at the respective ends. No waste occurs with this type of carrying handle production. To produce the cross tape (6), the slit plastic tape (see FIG. 2) can be separated into individual cross tapes (2) by means of a lozenge-shaped stamping tool.

I claim:

1. An open cuboid packaging bag for sanitary articles, said bag comprising:

a plastic bag foil (8) having a face wall (15), a rear wall 16, two front walls (11) closed by a pair of first weld seams (18), a bottom (14) closed by a second weld seam (19) and a cover wall (5), said cover wall having two triangular end areas (10), each of said two triangular end areas (10) respectively engaged to a front wall of said two front walls (11), said bag further having a carrying handle made from a plastic foil tape extending over the entire cover wall (5) between the front walls, said carrying handle having two split ends (6) each respectively welded to the bag close to the ends of the face wall and the rear wall, and a perforation line (12, 12*a*) of a tear strip (13) cut into the bag located between the split ends (6);

wherein each said end of said two split ends (6) is respectively inserted vertically from above between the two triangular end areas and the two front walls, wherein said end is welded with an upwardly folded-over end (6A) to a doubled bag foil (8) in a corner area at an end of the packaging bag wherein when said bag is in a folded configuration said cover wall is folded in an M-shaped head fold (4) with said two triangular end areas respectively folded up on an inside of an adjoining front wall (11).

2. A packaging bag in accordance with claim 1, wherein each said end of said two split ends of the carrying handle extends symmetrically in a linear direction and is formed by separating slits over approximately ⅓ of the entire plastic foil tape length, wherein a section in a center between each said end of said two split ends, constitutes a carrying element (7).

3. A packaging bag in accordance with claim 1, wherein each said end of said two split ends (6) has an end edge at an end, said end edges being parallel to the first weld seams (18).

4. A packaging bag in accordance with claim 1, wherein each said end of said two split ends (6) has an end edge extending transversely with respect to a longitudinal axis of the carrying handle.

5. A packaging bag in accordance with claim 1 wherein each said end of said two split ends (6) is welded on an inside of front wall (11) of the bag foil (8), said end being doubled in the corner area at an end of the packaging bag (3) slightly below a side of the cover wall (5) in a linear direction with respect to the second weld seam (19).

6. A packaging bag in accordance with claim 1, wherein each said end of said two split ends (6) is welded with the bag foil (8), said end being doubled in the corner area at an end of the packaging bag (3) transversely to a linear direction of the second weld seam (19).

7. A packaging bag in accordance with claim 1, wherein each said end of said two split ends is welded with the bag foil (8), said end being doubled in the corner area at an end of the packaging bag (3) in a diagonal position in respect to the linear direction of the second weld seam (19).

8. A packaging bag in accordance with claim 1, wherein each said end of said two split ends (6) is welded with a doubled bag foil (8) by means of two weld seams **(9*a*, 9*b*), wherein a first weld seam (9*a*) of said two weld seams extends in a longitudinal direction of a split end of said split ends (6), and a second weld seam (9*b*) of said weld seams is slightly below and to a side of the cover wall (5) in a linear direction of the second weld seam (19)**.

9. A packaging bag in accordance with claim 1, wherein each said end of said two split ends (6) is welded to a doubled bag foil (8) by means of a circular weld seam (20).

10. A packaging bag in accordance with claim 1, wherein each said end of said two split ends (6) is welded to a doubled bag foil (8) by means of triangularly disposed weld seam.

11. A packaging bag in accordance with claim 1, wherein each said end of said two split ends (6) is welded to a doubled bag foil (8) by means of a rectangularly disposed weld seam.

12. A packaging bag in accordance with claim 1, wherein each said end of said two split ends (6) is welded to a doubled bag foil (8) by means of a weld surface (21) in the shape of a circle.

13. A packaging bag in accordance with claim 1, wherein each said end of said two split ends (6) is welded to a doubled bag foil (8) by means of a weld surface (21) in the shape of a triangle.

14. A packaging bag in accordance with claim 1, wherein the perforation line (12A) extends over the triangle (10) and the front wall (11).

15. A packaging bag in accordance with claim 14, wherein the perforation line (12A) also extends onto the cover wall (5).

* * * * *